US007272963B2

(12) United States Patent
Rosenberg et al.

(10) Patent No.: US 7,272,963 B2
(45) Date of Patent: Sep. 25, 2007

(54) GATE LATCH

(75) Inventors: Avron S. Rosenberg, Golden Valley, MN (US); Ben Bricko, Dundas, MN (US)

(73) Assignee: Cargo Protectors, Inc., Minneapolis, MN (US)

( * ) Notice: Subject to any disclaimer, the term of this patent is extended or adjusted under 35 U.S.C. 154(b) by 230 days.

(21) Appl. No.: 10/939,944

(22) Filed: Sep. 13, 2004

(65) Prior Publication Data

US 2005/0061041 A1 Mar. 24, 2005

Related U.S. Application Data

(60) Provisional application No. 60/501,989, filed on Sep. 11, 2003, provisional application No. 60/539,221, filed on Jan. 26, 2004.

(51) Int. Cl.
*E05B 65/06* (2006.01)

(52) U.S. Cl. ..... 70/126; 292/175; 292/288; 292/259 R; 70/127

(58) Field of Classification Search ..... 70/126, 70/127; 292/175, 259 R, 288, 289
See application file for complete search history.

(56) References Cited

U.S. PATENT DOCUMENTS 4,062,575 A * 12/1977 Robins ..... 292/67
4,198,088 A * 4/1980 Tochihara ..... 292/288
4,372,136 A * 2/1983 Mickelson ..... 70/14
4,545,150 A * 10/1985 Williams ..... 49/366
4,643,469 A * 2/1987 Johnston et al. ..... 292/66
5,024,473 A * 6/1991 McQuade ..... 292/120
5,103,658 A * 4/1992 McQuade ..... 70/77
5,404,734 A * 4/1995 Martinez ..... 70/34
5,419,165 A * 5/1995 Perkins ..... 70/14
5,447,346 A * 9/1995 Virzi ..... 292/289
5,931,032 A * 8/1999 Gregory ..... 70/129
6,351,975 B1 * 3/2002 Valdes ..... 70/56
6,834,896 B2 * 12/2004 Smith ..... 292/259 R
6,983,629 B1 * 1/2006 Gogel ..... 70/14
7,017,958 B1 * 3/2006 Bowers ..... 292/281
7,021,678 B1 * 4/2006 Raoult ..... 292/63
7,044,512 B1 * 5/2006 Moreno ..... 292/259 R

OTHER PUBLICATIONS

Undated brochure for Fence-Loc—Heavy Duty Double Drive Industrial Gate Latches (2 pgs).

* cited by examiner

*Primary Examiner*—Suzanne Dino Barrett
(74) *Attorney, Agent, or Firm*—Patterson, Thuente, Skaar & Christensen, P.A.

(57) ABSTRACT

A gate latch including a bolt portion, a sleeve portion and a channel bolt. The sleeve portion is mounted on a generally U-shaped clamp assembly that is adapted to fit around tubular gate members. The sleeve portion further includes a receiving notch and a padlock portion. The padlock portion is adapted to receive a standard padlock and to surround the shackle of the padlock so as to deter attempts to attack the shackle with cutting tools. The bolt portion includes a C-shaped channel adapted to be secured around tubular gate members and a sleeve in which the channel bolt slides. The channel bolt generally includes an elongate channel, an adjustable stop, a dead stop, a handle and a locking notch.

48 Claims, 17 Drawing Sheets

GATE LATCH

CLAIM TO PRIORITY

This application claims priority to U.S. Provisional Patent Applications Ser. No. 60/501,989, filed Sep. 11, 2003, and Ser. No. 60/539,221, filed Jan. 26, 2004, both entitled GATE LATCH, the entire contents of which are incorporated herein by this reference.

FIELD OF THE INVENTION

The invention generally relates to a latch for securing fence gates. More particularly, the invention relates to a gate for providing high-strength security for link fence gates.

BACKGROUND OF THE INVENTION

A large portion of the products sold in commerce in the United States are transported by truck. Consequently, theft from trucks and trucking companies is a serious concern. Trucking companies, loading docks and storage yards typically have wide driveways to accommodate easy access for large trucks coming and going. These facilities also are typically surrounded by tall chain link fences to discourage theft and vandalism. Because of the wide driveways, a double driveway truck gate is typically provided in the fence in order to provide easy ingress and egress of trucks to the property. These gates typically have two large panels that swing on hinges. Some gates, however, have panels that slide in parallel to the fence line. These gates are the most obvious and often easiest point of access to a closed yard for thieves or vandals. Thus, there is a need for high strength, high security latching mechanisms to secure these gates and protect them from unauthorized access.

A common quality of most fence gates utilized in the trucking industry is that, when closed, the gate presents two tubular members positioned near one another. Some tubular members are circular in cross section and some are polygonal, generally square or rectangular, in cross section. Some swinging gates have two swinging panels that meet centrally. Others have one swinging panel that may be locked to a fixed post. Traditionally a chain and padlock would be wrapped around these two tubular members to secure them together to lock the gate. Unfortunately chains and padlocks are subject to cutting with bolt cutter as well as to breakage by prying.

A currently available gate lock includes two U-shaped channels that are wrapped around the tubular structures of two portions of the gate. The U-shaped channels may then be interlocked by a locking bar, which is then secured by a standard padlock. This mechanism requires that the gate lock be rotated relative to the vertical gate members in order to insert the locking bar into an opening to provide alignment before the padlock may be secured. It would be desirable to be able to use a locking mechanism without the necessity to manipulate the latch to this degree.

SUMMARY OF THE INVENTION

The present invention solves many of the above problems by providing a high security, high strength latching mechanism for industrial gates that can be engaged and disengaged without the need to rotate the latch mechanism, to provide alignment between the two portions of the latch.

The gate latch of the present invention generally includes a bolt portion, a sleeve portion and a channel bolt. The sleeve portion is mounted on a U-shaped clamp assembly that is adapted to fit around tubular gate members. The sleeve portion further includes a receiving notch and a padlock portion. The padlock portion is adapted to receive a standard padlock and to surround the shackle of the padlock so as to deter attempts to attack the shackle with cutting tools. Alternately, an integral lock may be incorporated into the gate latch. For example, a cam lock may be used to secure the channel bolt. The bolt portion also includes a generally C-shaped channel adapted to be secured around a tubular gate member and a sleeve in which the channel bolt slides. The channel bolt generally includes an elongate channel, an adjustable stop, a dead stop, a handle and a locking notch. The channel bolt is adapted to slide within a sleeve to retract, allowing the gate to be opened and to extend to secure the gate. The channel bolt is then secured to the sleeve portion through the padlock portion with a standard heavy-duty padlock in order to secure the gate.

In one embodiment, the C-channel is adapted to be slipped around a tubular portion of the gate or fencing structure and then to be secured by bolts. The securement portions of the C-channel are adapted to deform when the bolts are tightened so that even if the bolts are removed, the C-channel is still difficult to remove from the tubular member of the fence or gate.

In another embodiment, the invention includes a C-shaped spacer to adapt the C-channel for attachment to different sized tubular members.

DETAILED DESCRIPTION OF THE INVENTION

Figure 1:
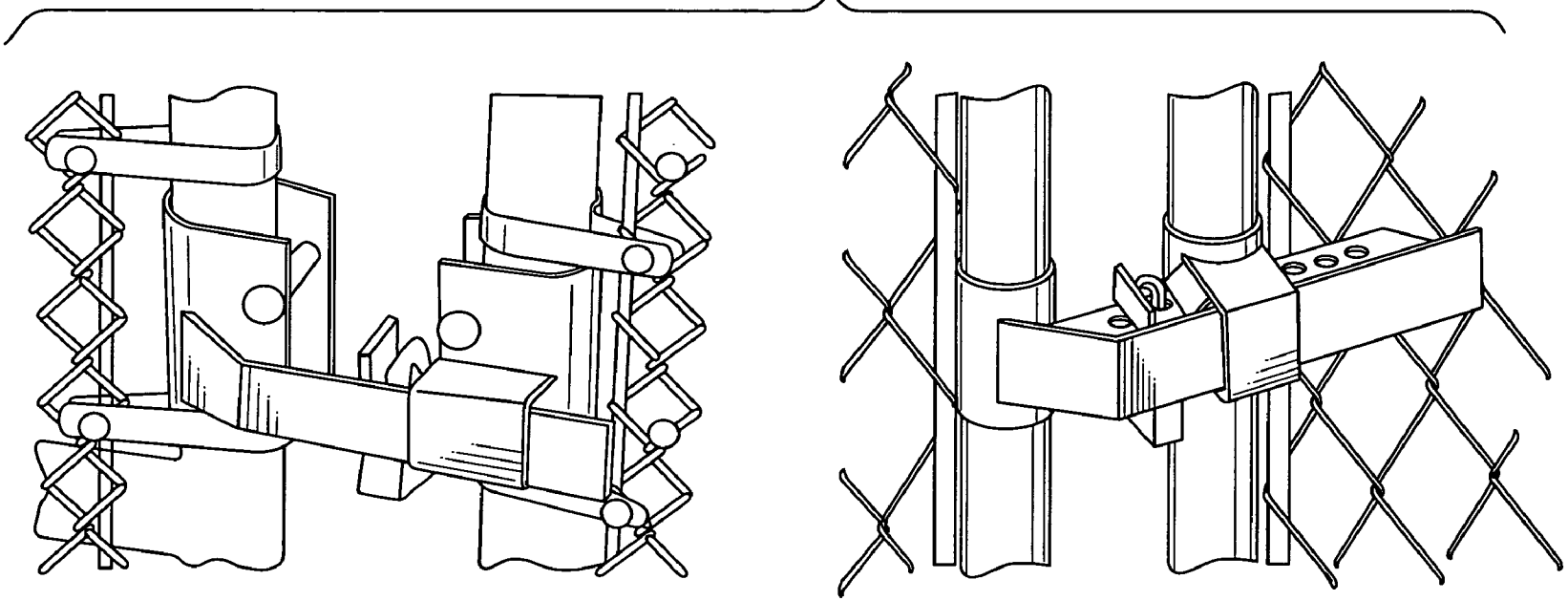
Fig. 1 Prior Art
FIG. 1 depicts a prior art gate latch.
Figure 2:
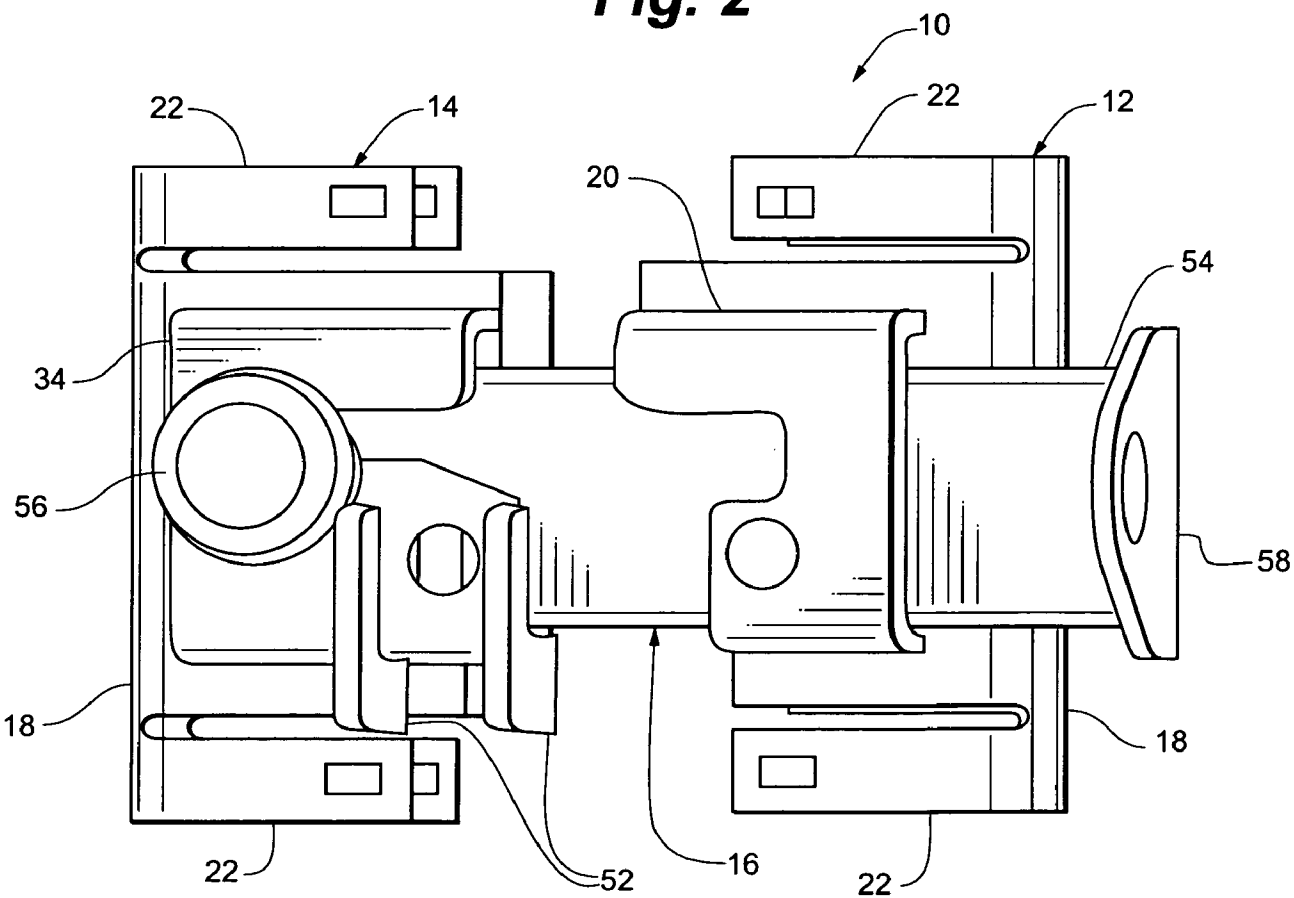
FIG. 2 is a perspective view of an embodiment of a gate latch in accordance with the present invention.
Figure 3:
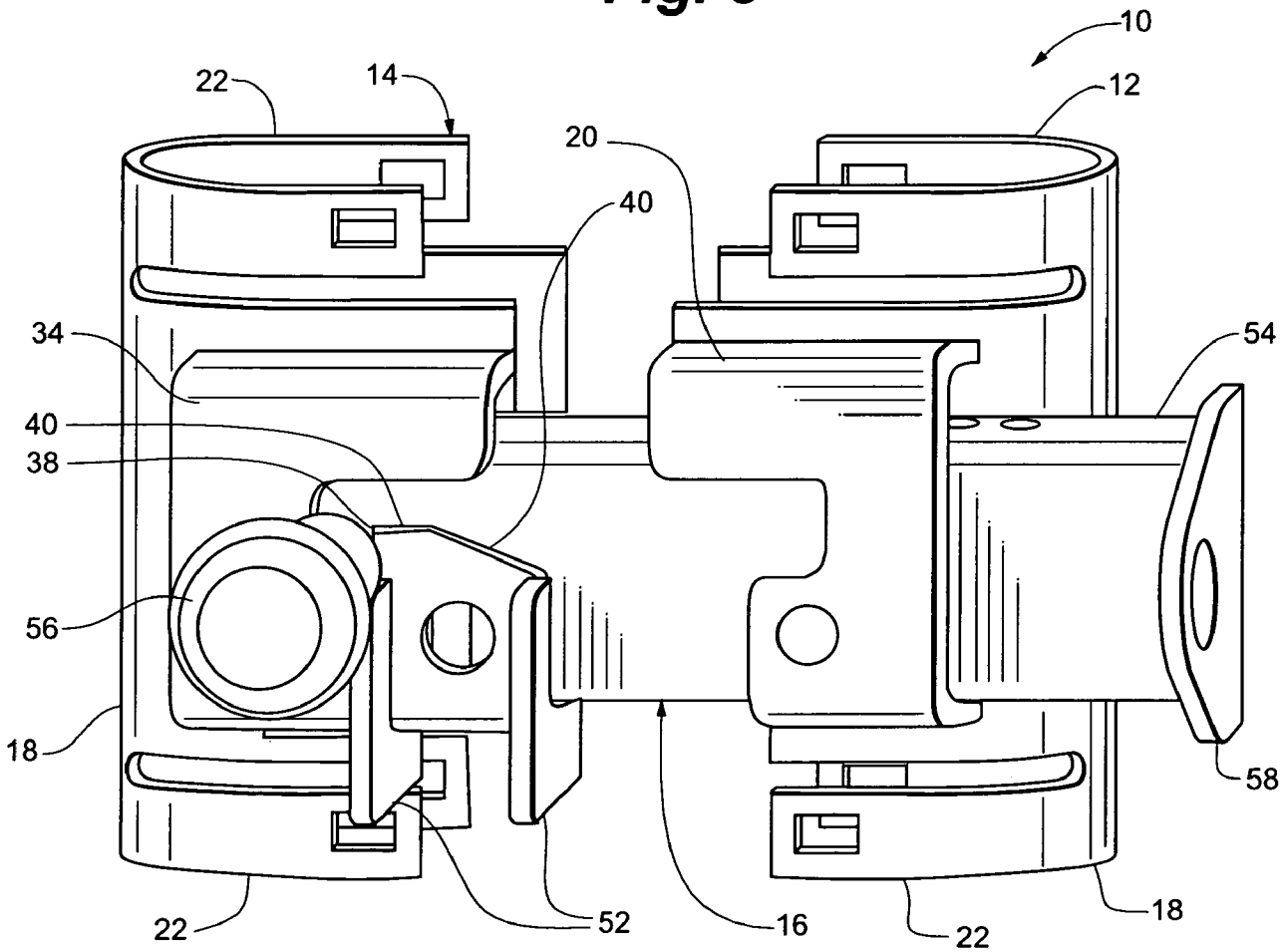
FIG. 3 is another perspective view of a gate latch in accordance with the present invention.
Figure 4:
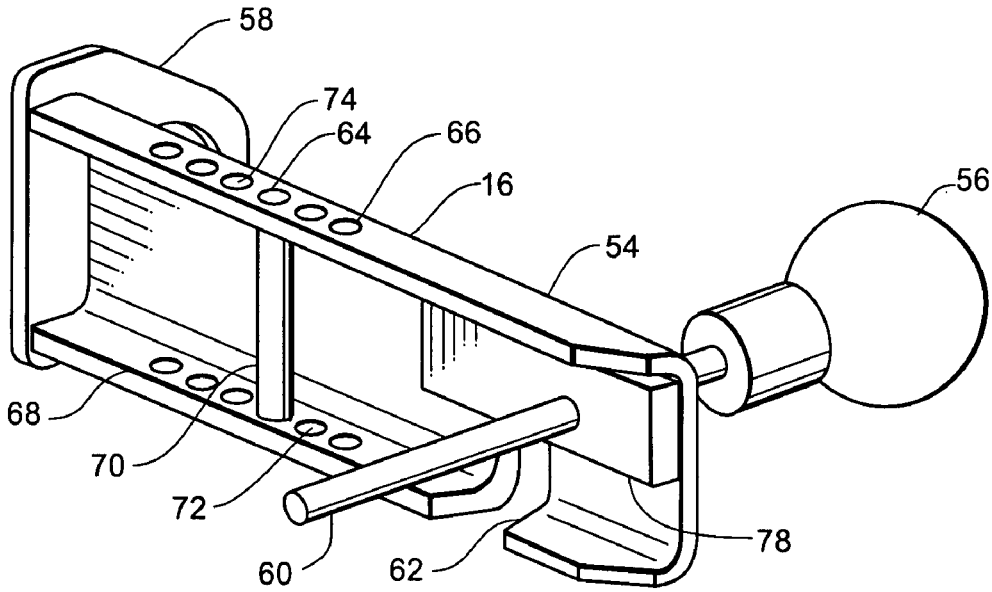
FIG. 4 is a perspective view of a channel bolt as used in accordance with an embodiment of the present invention.

Gate lock 10, as depicted in FIGS. 3 and 4, generally includes sleeve portion 12, padlock portion 14 and channel bolt 16.

Figure 5:
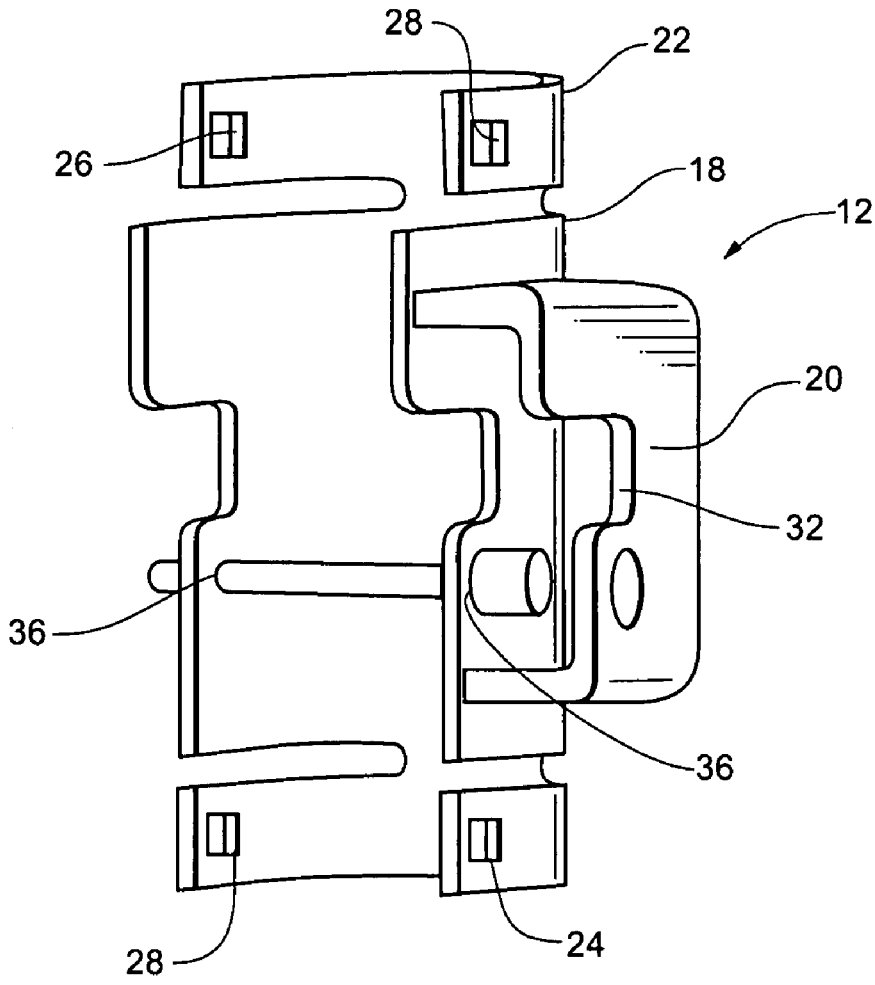
FIG. 5 is a perspective view of a C-channel as used in accordance with an embodiment of the present invention.
Figure 6:
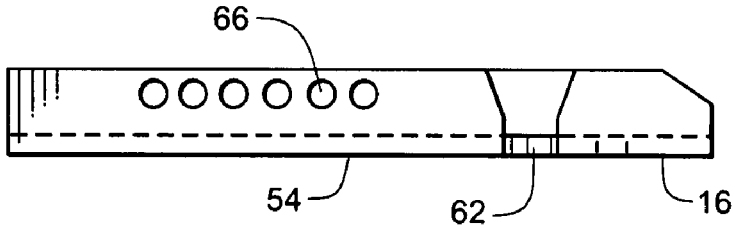
FIG. 6 is a top plan view of a channel bolt in accordance with the present invention.
Figure 7:
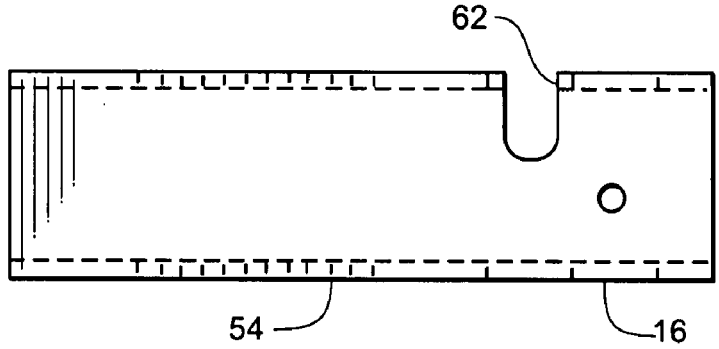
FIG. 7 is a front plan view of the channel bolt of FIG. 11.
Figure 8:
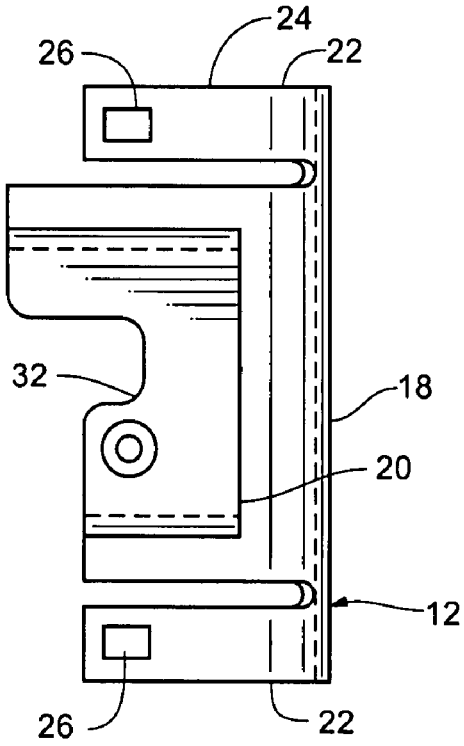
FIG. 8 is a front plan view of a C-channel in accordance with the present invention.
Figure 9:
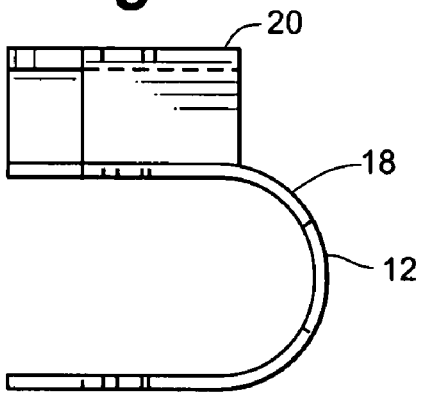
FIG. 9 is a top plan view of a C-channel in accordance with the present invention.
Figure 10:
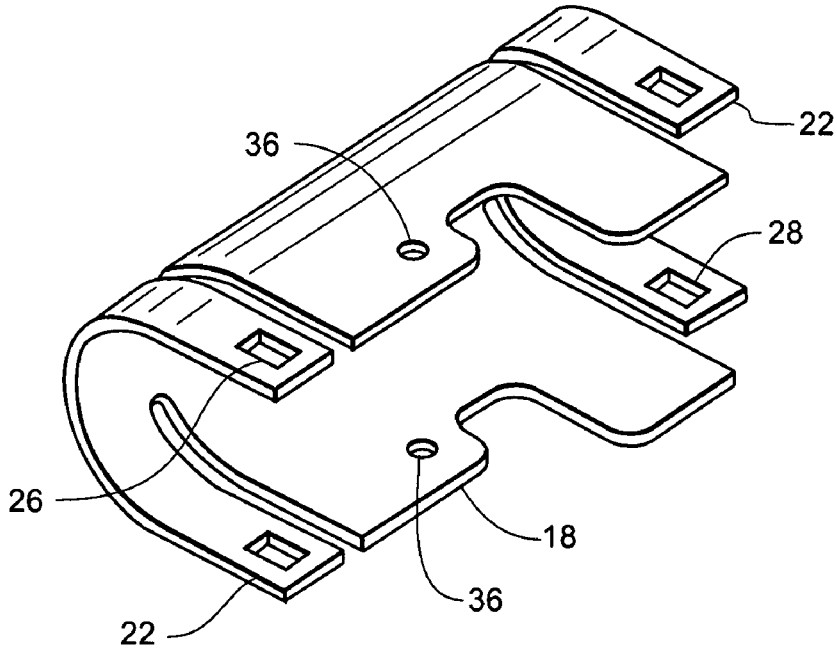
FIG. 10 is a perspective view of a C-channel in accordance with the present invention.
Figure 11:
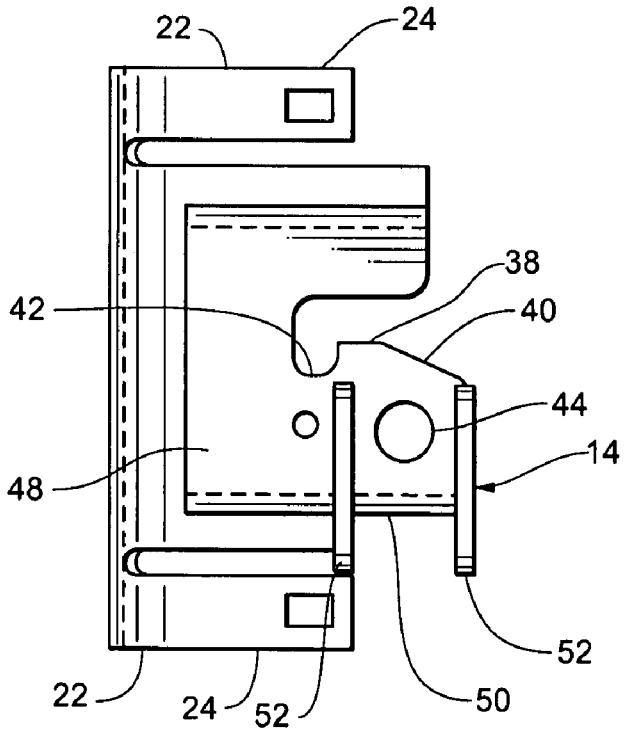
FIG. 11 is a front plan view of a padlock sleeve in accordance with the present invention.
Figure 12:
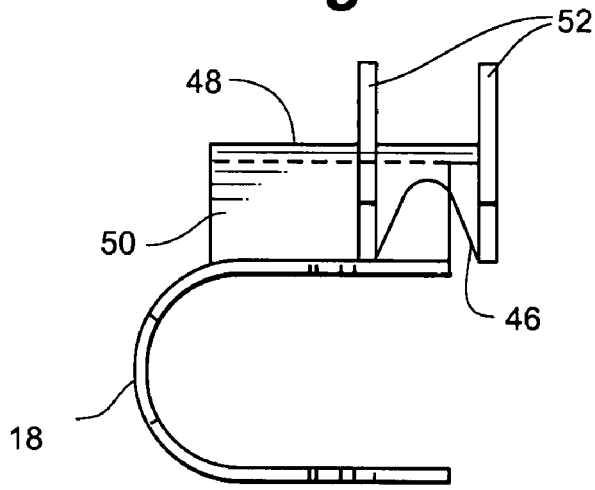
FIG. 12 is a top plan view of the padlock sleeve of FIG. 11.

Referring to FIGS. 2, 3, 5, 8, and 9 sleeve portion 12 generally includes C-channel 18 and sleeve 20. As seen in FIGS. 5, 8 and 9, C-channel 18 is an elongate C-shaped structure, the opening of which is sized to fit around a tubular gate member. In one embodiment, C-channel 18 includes mounting devises 22. Mounting devises 22 can be an integrally formed part of C-channel 18 and formed of a malleable material. Mounting clevis 22 can include two ears 24. Each ear 24 is pierced by a bolt hole 26. Optionally, one of each pair of bolt holes 26 can be a square hole 28 and the other can be a round hole 30; or both bolt holes 26 may be square or a rectangular slot. This allows mounting clevis 22 to accommodate a carriage bolt 31 for mounting as seen in FIGS. 19-26.

When the carriage bolt 31 is tightened, ears 24 of mounting clevis 22 deform inwardly to narrow the opening and wrap around a tubular gate member. Once ears 24 have been deformed by tightening carriage bolt 31, mounting clevis 22 will grip a tubular gate member securely and make sleeve portion 12 or padlock portion 14 difficult to remove from the tubular gate member. In addition, rotational movement of the clevis 22 is substantially limited by the clamping of mounting clevis 22 around the tubular gate member.

Referring to FIGS. 2, 3 and 13-26, sleeve 20 is sized and proportioned to receive channel bolt 16 in a somewhat loose sliding fit. Sleeve 20 is securely attached to sleeve portion 12, preferably by welding. Sleeve 20 defines handle notch 32. Handle notch 32 is a generally U-shaped cutout which may have a flared opening on an upper portion thereof.

Padlock portion 14, as seen in FIGS. 2, 3 and 11-26 includes C-channel 18 and padlock sleeve 34. C-channel 18 is similar in structure to the C-channel 18 associated with sleeve portion 12. For ease of manufacturing, C-channel 18 may be identical in structure for both sleeve portion 12 and padlock portion 14. C-channel 18 may have mounting holes 36 bored therethrough in order to allow for passing a fastener through mounting holes 36 and directly through a tubular gate member. In this embodiment, holes are placed through the tubular gate member in order to accommodate a bolt, rivet or other fastener. As seen in FIG. 5, mounting holes 36 may be positioned so that when channel bolt 16 is in the closed position mounting hole 36 is covered by channel bolt 16 thus preventing removal of a fastener inserted in mounting hole 36.

Padlock sleeve 34 is preferably securely attached to C-channel 18 such as by welding. Padlock sleeve 34 defines primary latch notch 38. Primary latch notch 38 includes ramp 40 and gravity notch 42. Gravity notch 42 is a downwardly sloped cutout in primary latch notch 38. Padlock sleeve 34 further defines shackle hole 44 and shackle notch 46. Shackle hole 44 is sized to receive the shackle of a standard padlock. Shackle notch 46 is also sized to accommodate the shackle of a standard padlock. Shackle hole 44 is located in front face 48 of padlock sleeve 34. Shackle notch 46 is located in lower face of padlock sleeve 34. Thus, shackle hole 44 and shackle notch 46 are located near and transverse to one another.

Figure 28:
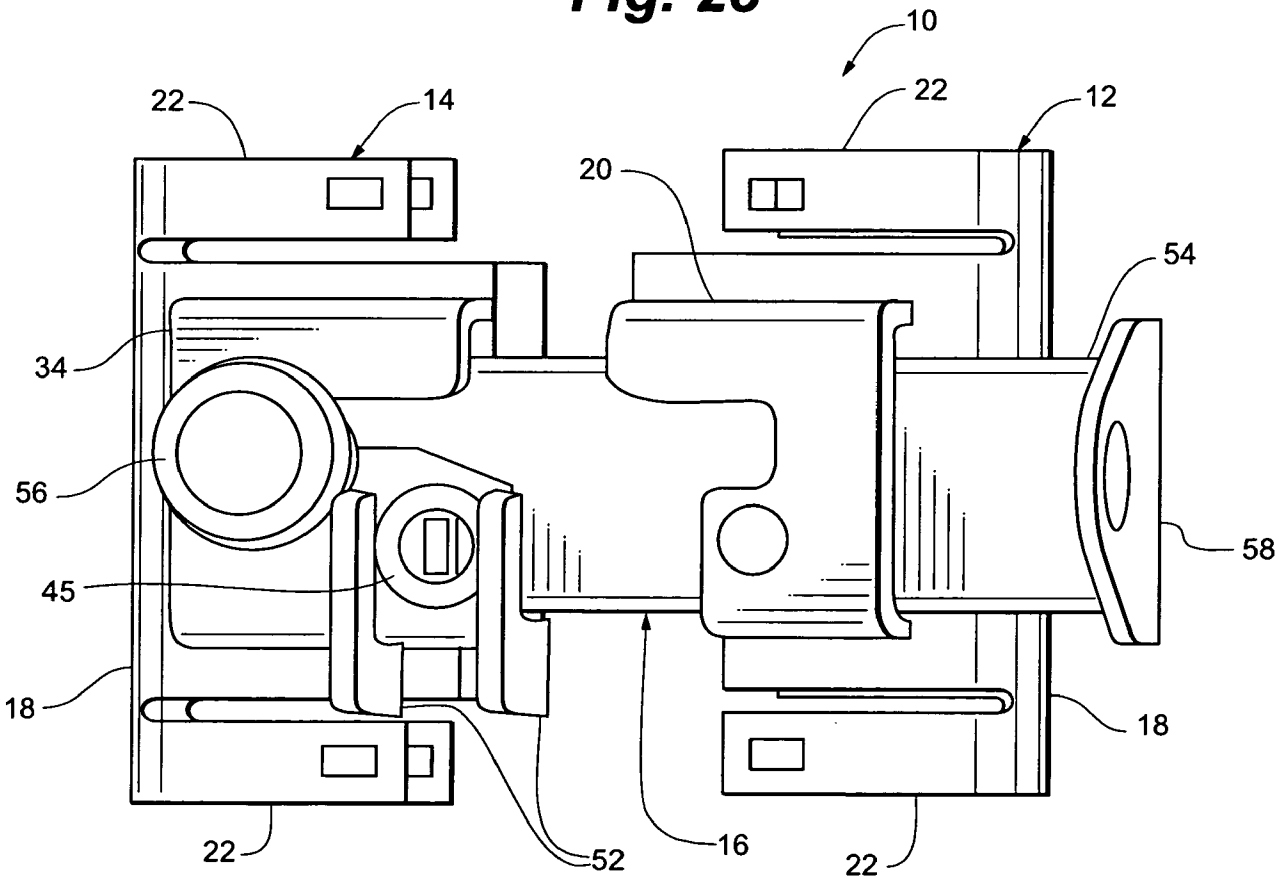
FIG. 28 is a perspective view of another embodiment of a gate latch in accordance with the present invention.

Referring to FIG. 28, alternatively an integrally mounted locking mechanism 45 may be incorporated into padlock sleeve 34. For example, a cam lock may be built into padlock sleeve 34 with its bolt or cam positioned to pass through shackle hole 44 or shackle notch 36. One skilled in the art can utilize another type of integrally mounted locking mechanism 45 without departing from the scope of the present invention.

In one embodiment, padlock sleeve 34 further includes shackle protectors 52 seen in FIGS. 2, 3, and 11-26. Shackle protectors 52 extend outwardly from front face 48 and down from lower face 50 to surround a padlock shackle and case in a close fitting fashion. Shackle protectors 52 serve to make it difficult to gain access to the padlock or its shackle with bolt cutters, saws or other tools, thus making it difficult for thieves to cut the padlock.

Referring to FIGS. 2-4 and 13-26, channel bolt 16 generally includes channel 54, handle 56 and dead stop 58. Channel bolt 16 is preferably formed of steel or another high strength material. Channel bolt 16 is sized for a loose sliding fit within sleeve 20. Handle 56 is secured to channel bolt 16 so as to provide a convenient location for grasping channel bolt 16. Handle 56 is further adapted to have a stem 60 that is sized to fit into gravity notch 42. When stem 60 is slid into gravity notch 42, stem 60 will be raised as it is slid up ramp 40 and ultimately stem 60 will drop because of gravity into gravity notch 42. Thus, stem 60 will engage gravity notch 42 and hold channel bolt 16 engaged within padlock sleeve 34. In some embodiments of the invention stem 60 is extended to serve as an alternate or additional location to grasp channel bolt 16.

Referring to FIGS. 2-4 and 13-26, dead stop 58 desirably is a flange secured to the opposite end of channel 54 from handle 56. Dead stop 58 is sized to prevent channel bolt 16 from passing through sleeve 20 in a forward direction. Dead stop 58 is also shaped to allow convenient grasping of channel bolt 16.

Figure 27:
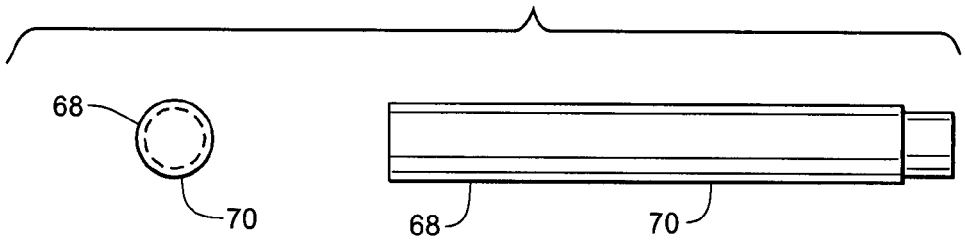
FIG. 27 is a stepped pin in accordance with the invention.

Channel 54, as seen in FIGS. 4, 6, 7 and 13-26, further defines locking notch 62 and adjustable stop 64. For example, adjustable stop 64 may include a series of stop holes 66 and a stop member 68. In this case, stop member 68 is selectively attachable to any of stop holes 66 in order to stop channel 54 from sliding through sleeve 20 prior to dead stop 58 meeting sleeve 20. Referring to FIG. 27, stop member 68 may be a stepped pin 70. In this case upper stop holes 72 are larger than lower stop holes 74. Stepped pin 70 may be inserted from above without tools and will rest in the lower stop holes 74. Thus when channel bolt 16 is slid into sleeve 20 stepped pin 70 limits its movement by impinging on bolt 76 and sleeve 20 and covers and sleeve 20 prevents removal of stepped pin 70.

Channel 54 is further configured so that when stem 60 of handle 56 is secured in gravity notch 42. Locking notch 62 is aligned with shackle hole 44 and shackle notch 46. Thus, a standard padlock shackle may be passed through shackle hole 44, locking notch 62 and then shackle notch 46 in order to secure gate lock 10 in a locked position.

Channel 54, as seen in FIG. 4, may further include weight 78 at the same end as the location of handle 56. Weight 78 counterbalances the weight of channel bolt 16 and ensures that stem 60 will be pulled by gravity into gravity notch 42 to secure gate lock 10.

Figure 15:
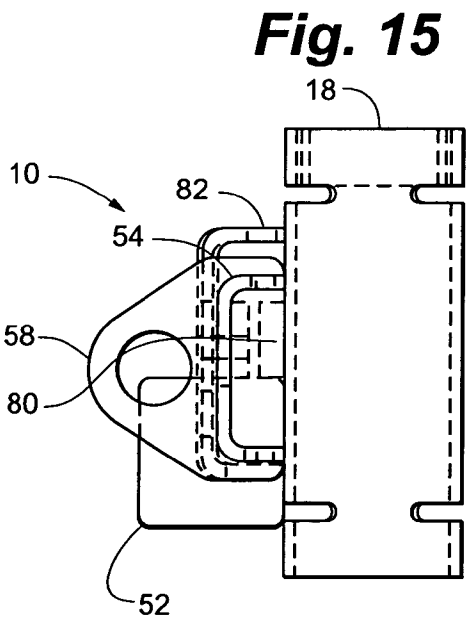
FIG. 15 is a side plan view of the embodiment depicted in FIG. 13 in accordance with the present invention including hidden parts shown in phantom.
Figure 13:
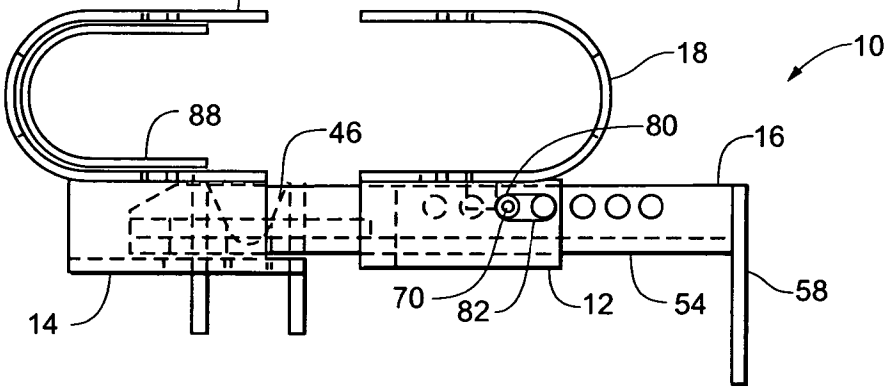
FIG. 13 is a top plan view of another embodiment of the gate lock in accordance with the present invention including hidden parts shown in phantom.
Figure 14:
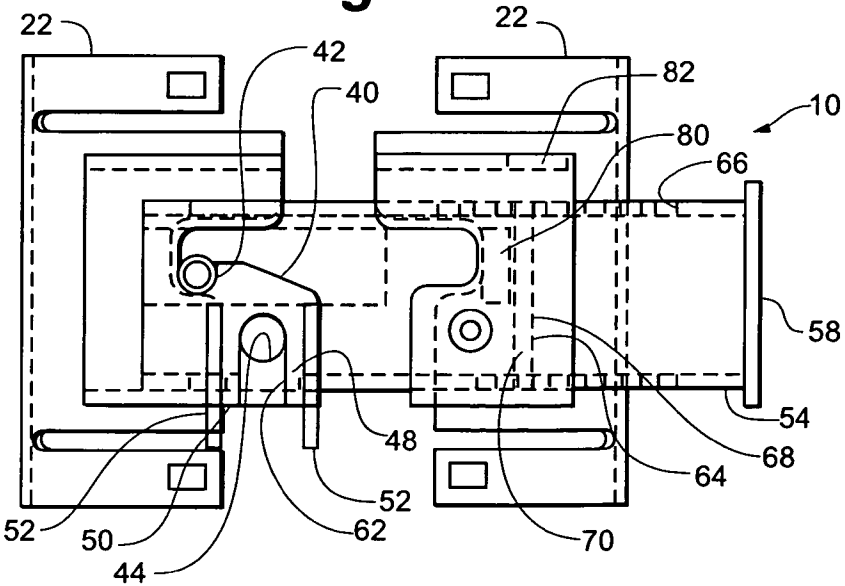
FIG. 14 is a front plan view of the embodiment depicted in FIG. 13 in accordance with the present invention including hidden parts shown in phantom.
Figure 18:
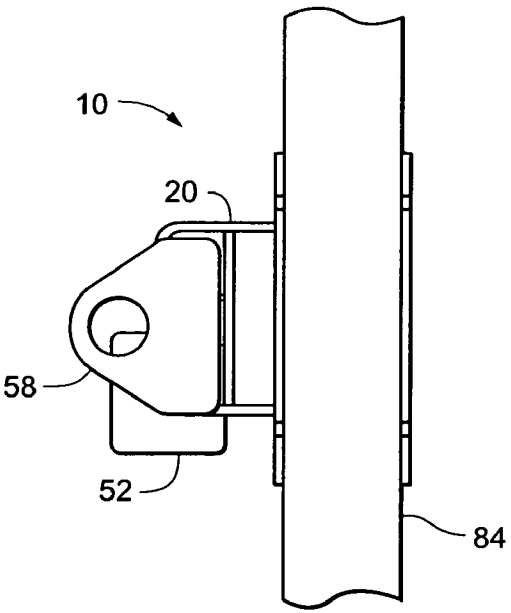
FIG. 18 is a side plan view of the embodiment depicted in FIG. 16 in accordance with the present invention including hidden parts shown in phantom.
Figure 16:
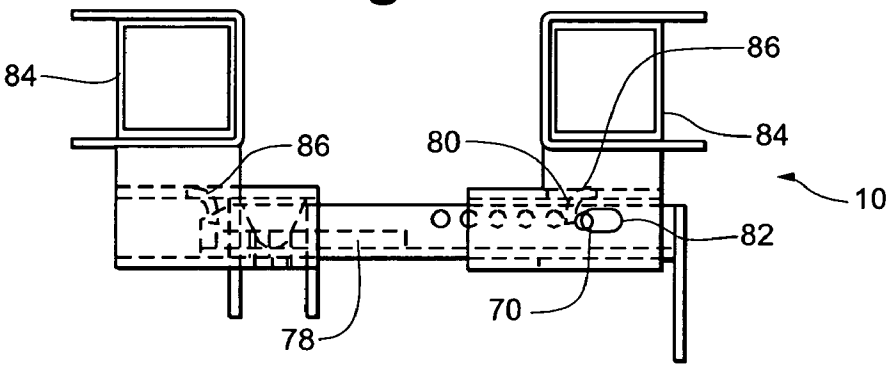
FIG. 16 is a top plan view of another embodiment of the gate lock in accordance with the present invention including hidden parts shown in phantom.
Figure 17:
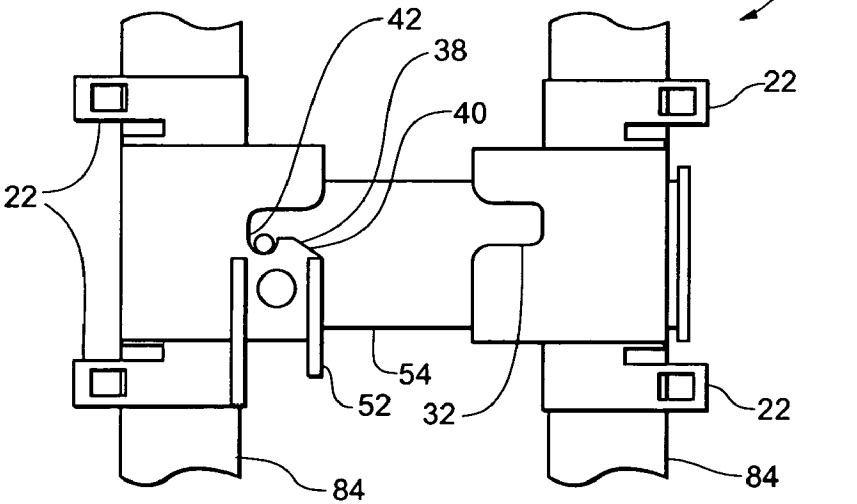
FIG. 17 is a front plan view of the embodiment depicted in FIG. 16 in accordance with the present invention including hidden parts shown in phantom.

Referring to FIGS. 13-15, another embodiment of the invention is depicted. This embodiment is generally similar to the previously disclosed embodiments but further includes stop block 80. Stop block 80 is secured to C-channel 18. Stop block 80 is located so that when channel bolt 16 is inserted through sleeve 20, stop block 80 interferes with the passage of stepped pin 70, so that channel bolt 16 cannot pass through sleeve 20 beyond a certain point. As indicated above, step pin 70 may be placed in any desired pair of lower stop holes 72 and upper stop holes 74, in order to stop channel bolt 16 at a desired location. Stepped pin 70 may also be replaced by a roll pin (not shown). A roll pin is resiliently compressible. Therefore, a roll pin may be driven into lower stop hole to removably secure it in place.

In addition, referring to the embodiment depicted in FIGS. 13-16, and 19-26, sleeve 20 may be pierced by window 82. As can be seen, window 82 is desirably oval or racetrack shaped and aligned so as to allow access and visibility to upper stop holes 74. The presence of window 82 allows an operator to view the location of upper stop holes 74 relative to stop block 80, thereby allowing a quick determination of which upper stop hole 74 should be occupied by step pin 70 in order to minimize the excess movement of channel bolt 16 relative to sleeve 20.

Referring now to FIGS. 16-18 and 23-26, another embodiment of the invention is depicted. This embodiment of the invention is particularly adapted for installation on square tubular gate members 84. It is to be noted that in this embodiment, C-channels 18 are reversed in orientation from the previously discussed embodiments. In addition, C-channels 18 are shaped to accommodate a square tubular gate member 84. This embodiment also facilitates installation of gate lock 10 on gate members formed of channel or angle materials. This feature facilitates easy installation on a square tubular gate member 84 and is valuable because when installed on a square tubular gate member 84, this embodiment of gate lock 10 can not be rotated relative to the square tubular gate member 84.

In addition, this embodiment of the invention depicts another embodiment of stop block 80. In this embodiment, stop block 80 is formed as a bent tab 86. Bent tab 86 is positioned so as to interfere with stepped pin 70 as channel bolt 16 is inserted through sleeve 20. In addition, bent tab 86 may also be formed on padlock portion 14 of gate lock 10. This embodiment is identified in FIG. 16 as bent tab 86'. In addition, referring to FIGS. 4 and 19-26 any of the embodiments described, can be constructed so that they lack handle 56, but retain extended stem 60. In these embodiments, an operator of gate lock 10 grasps channel bolt 16 by dead stop 58 and stem 60 in order to manipulate channel bolt 18.

Figure 19:
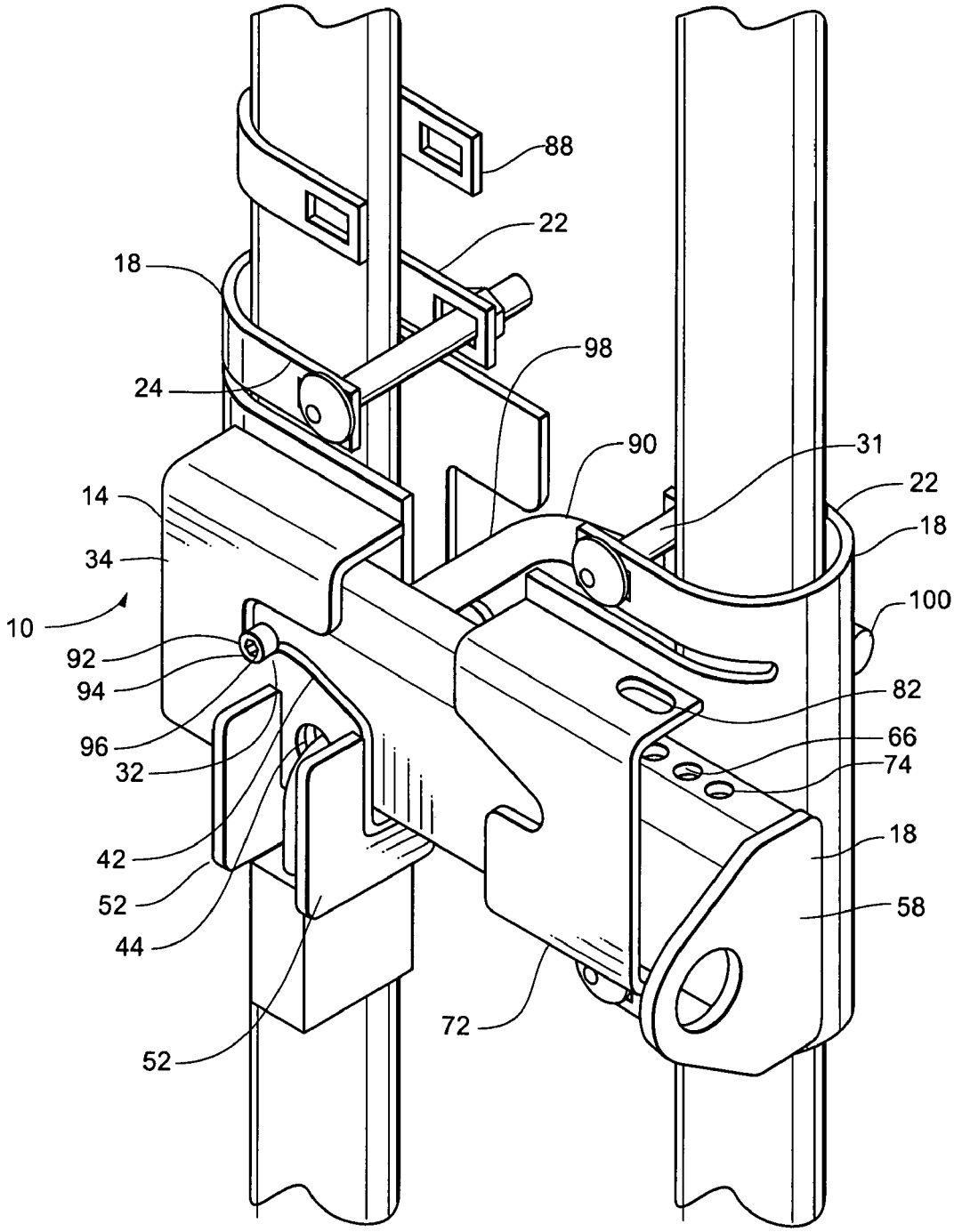
FIG. 19 is a perspective view of another embodiment of a gate latch in accordance with the present invention.
Figure 22:
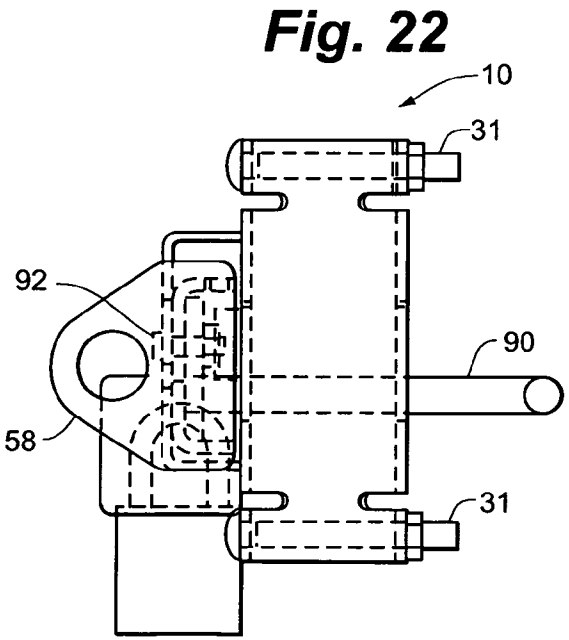
FIG. 22 is a side plan view of the embodiment depicted in FIG. 19 including hidden parts shown in phantom.
Figure 20:
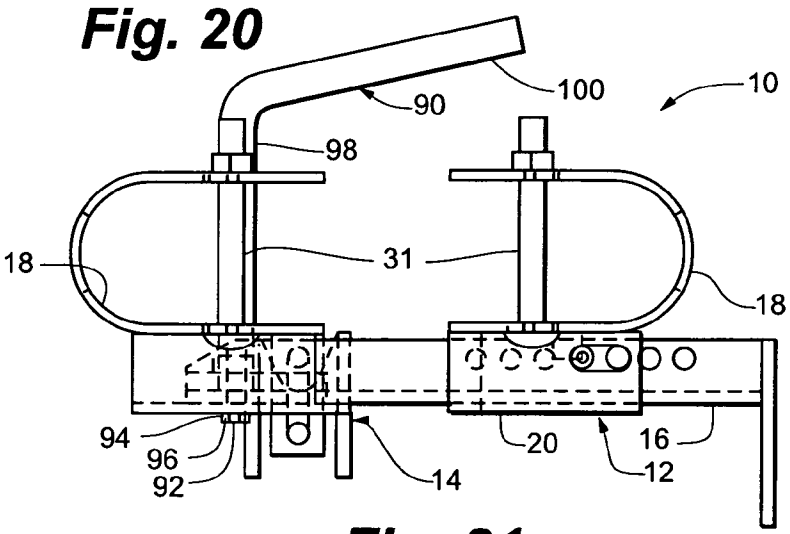
FIG. 20 is a top plan view of the embodiment depicted in FIG. 19 including hidden parts shown in phantom.
Figure 21:
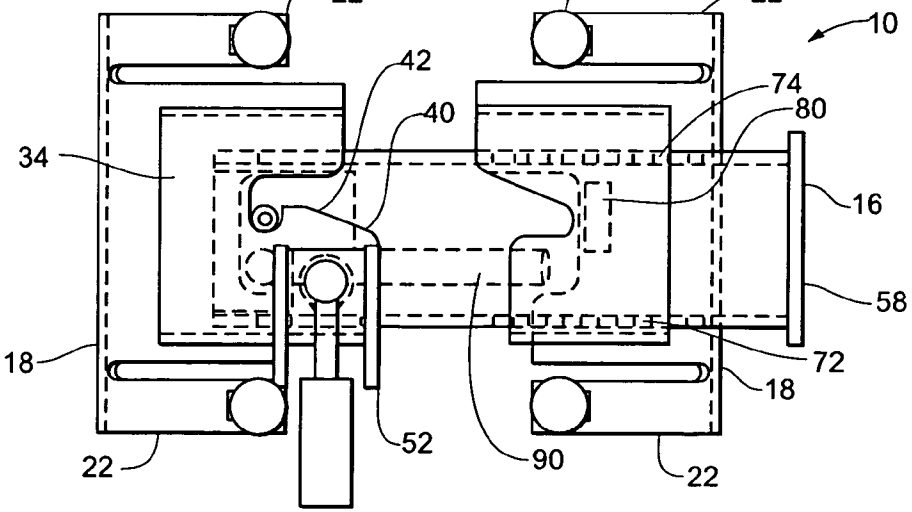
FIG. 21 is a front plan view of the embodiment depicted in FIG. 19 including hidden parts shown in phantom.
Figure 23:
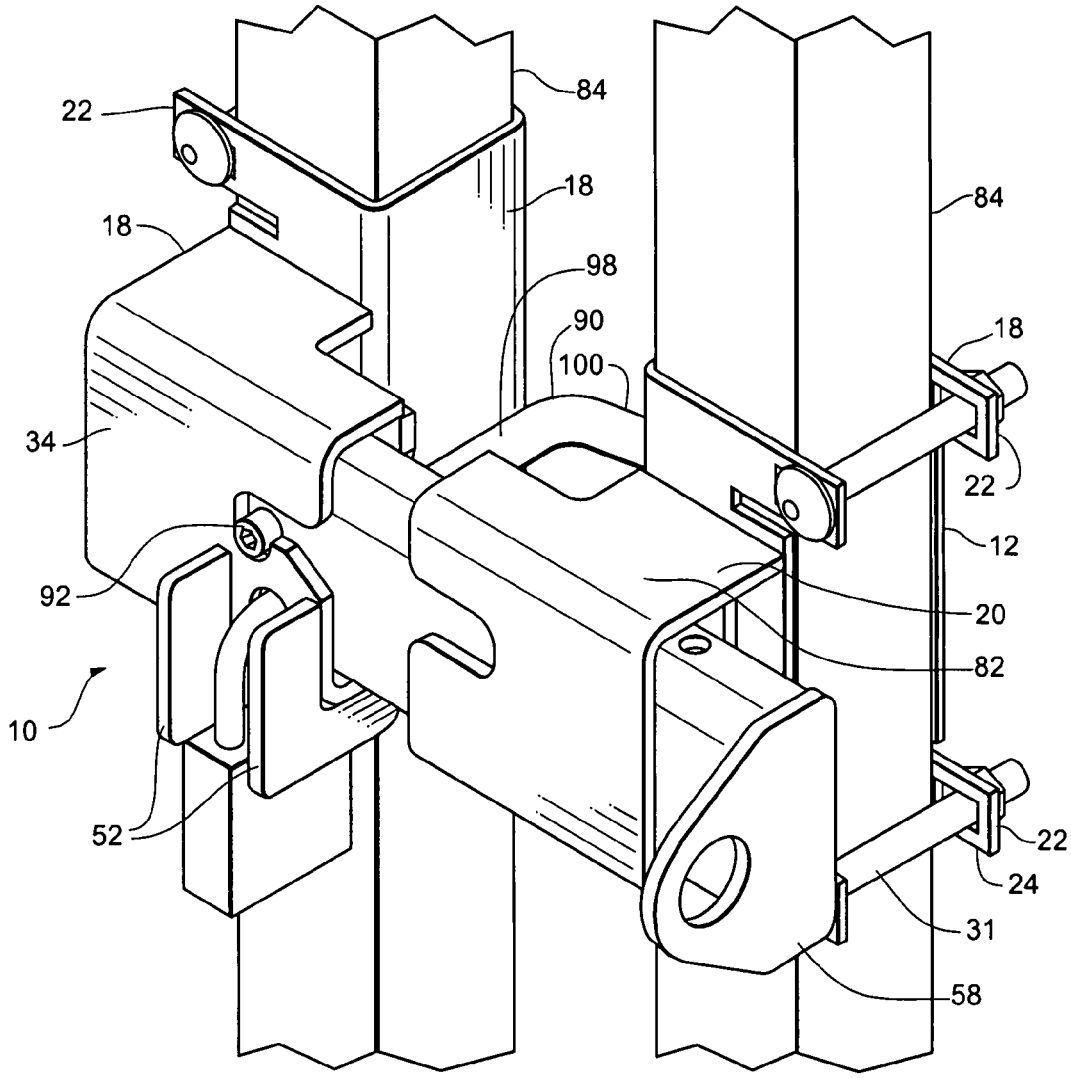
FIG. 23 is a perspective view of another embodiment of a gate latch in accordance with the present invention.
Figure 24:
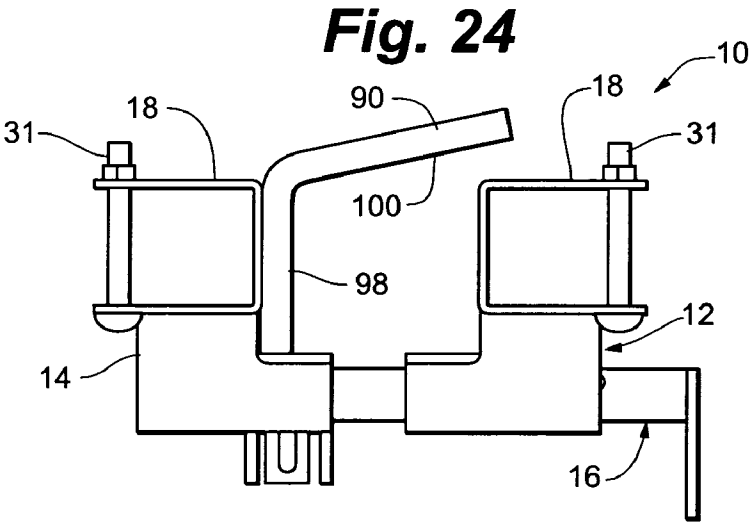
FIG. 24 is a top plan view of the embodiment depicted in FIG. 23.
Figure 26:
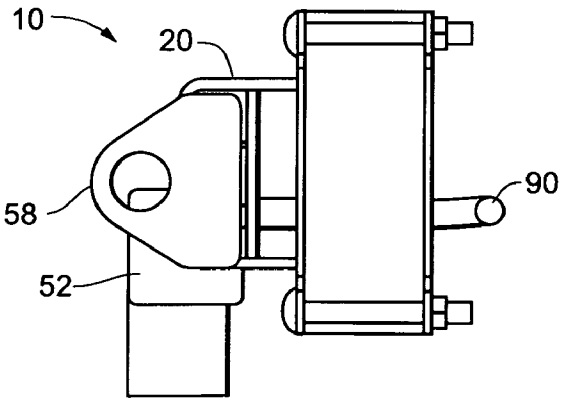
FIG. 26 is a side plan view of the embodiment depicted in FIG. 23.
Figure 25:
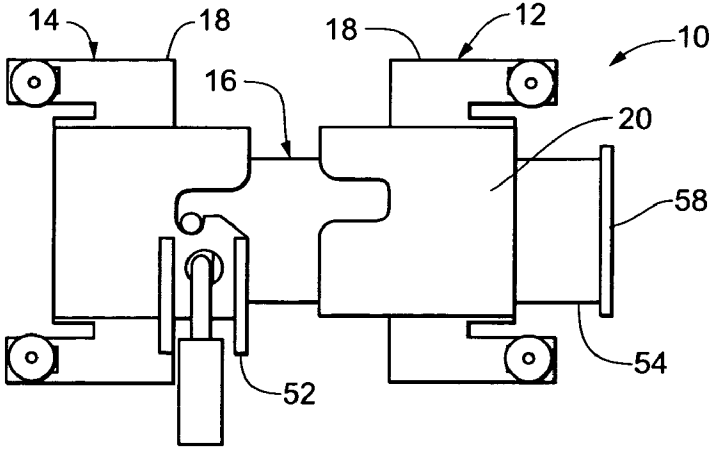
FIG. 25 is a front plan view of the embodiment depicted in FIG. 23.

In another embodiment, depicted in FIG. 19, gate lock 10 includes spacer 88. Spacer 88 is dimensioned to fit within mounting clevis 22. Spacer 88 fills space between mounting clevis 22 and a tubular gate member that is undersized relative to mounting clevis 22, thus permitting gate lock 10 to be mounted on various sized gate members.

In another embodiment, depicted in FIGS. 19-26, gate latch 10 is similar to embodiments described above except that stem 60 and handle 56 are not present. Instead, gate lock 10 includes bent handle 90 and short stem 92. Short stem 92 is sized to engage gravity notch 42. Short stem 92 may be formed as the head 94 of a bolt 96 used to secure bent handle 90 to gate latch 10.

Bent handle 90 includes straight portion 98 and bent portion 100. Bent portion 100 may be bent at an angle sufficient to allow for the passage of a tubular gate member between bent portion and mounting clevis 22 for ease of installation.

In another embodiment, C-channels 18 and mounting devises 22 are replaced by plates that can be bolted to a flat surface to allow gate lock 10 to be utilized on gate not having tubular members such as wooden or welded decorative metal gates.

In operation, gate lock 10 is secured to two tubular gate members. Sleeve portion 12 is secured to one tubular gate member and padlock portion 14 is secured to a second tubular gate member. Gate members may include one gate member on each panel of a two panel swinging gate or one gate member on a movable panel and a second gate member on a stationary tubular gate member. C-channel 18 of sleeve portion 12 is positioned so that its open end is opposed to and facing C-channel 18 of padlock portion 14.

In one embodiment, C-channel 18 is slid over a tubular fence member and carriage bolts 31 are passed through square hole 28 and round hole 30. Thus, the carriage bolts 31 close off mounting clevis 22. A nut is then placed onto the carriage bolt 31 and tightened thus deforming ears 24 inwardly, causing ears 24 to tend to wrap around a tubular gate member. Thus, even if carriage bolt 31 is removed, mounting clevis 22 is still very difficult to remove from a tubular gate member and rotation is limited.

In another embodiment, C-channel 18 has mounting holes 36 located so that a bolt 76 or other fastener may be passed through mounting hole 36 and a mating hole in a tubular fence member to secure C-channel 18 to the tubular fence member effectively precluding rotation of C-channel 18.

In mounting gate lock 10, sleeve portion 12 and padlock portion 14 are aligned so that channel bolt 16 may freely slide within sleeve 20 and into padlock sleeve 34. When this is done, stem 60 slides up ramp 40 and is forced by gravity into gravity notch 42 aligning shackle hole 44, shackle notch 46 and locking notch 62. A standard padlock is then secured through shackle hole 44, shackle notch 46 and locking notch 62 to secure channel bolt 16 within sleeve 20. Adjustable stop 64 removes slack from channel bolt 16 so as to prevent any unnecessary play between a gate panel and the other structure to which it is locked. This eliminates free play and substantially limits swaying of the secured gate.

Channel bolt 16, as used with gate lock 10, improves over the prior art in that it eliminates the need for the rotation of the gate lock 12. The prior art requires rotation of the lock mechanism relative to the gate tubular members to engage a locking bar with a receiving channel. The rotation of the prior art gate lock rotation allows slack in the lock which, in turn, allows the gate to sway and makes damage to the gate more likely as well as allowing easier access to the lock for thieves and vandals. The gate lock 10 of the present invention provides increased security.

Spacer 88 adapts gate latch 10 to accommodate mounting on various sized tubular gate members.

Embodiments depicted in FIGS. 19-26 can be readily operated from within or outside of a gate by use of bent handle 90 when an operator is inside the gate.

The present invention may be embodied in other specific forms without departing from the central attributes thereof, therefore, the illustrated embodiment should be considered in all respects as illustrative and not restrictive, reference being made to the appended claims rather than the foregoing description to indicate the scope of the invention.

What is claimed is:

1. A gate lock for securing gates having tubular gate members, the gate lock comprising:

a bolt member having a fixed stop at one end thereof and an engaging member extending outwardly therefrom, the bolt member further defining a hole therethrough;

a first portion including a first C-shaped portion to at least partially surround a first tubular gate member, a first sleeve defining an opening to receive a lock member, and a notch;

a second portion including a second C-shaped portion to at least partially surround a second tubular gate member proximate the first tubular gate member, a second sleeve being dimensioned to receive the bolt member therethrough but not allowing the passage of the stop therethrough; and the engaging member being positioned so that when the engaging member is engaged with the notch, the hole aligns with the opening to receive a locking member through both the hole and the opening for locking the bolt member to the first portion.

2. The gate lock as claimed in claim 1, the first or second C-shaped portion further comprising a mounting clevis having ears that are inwardly deformable.

3. The gate lock as claimed in claim 1, in which the first or second C-shaped portions are shaped to fit a tubular gate member having a generally circular cross section.

4. The gate lock as claimed in claim 1, in which the first or second C-shaped portions are shaped to fit a tubular gate member having a generally square cross section.

5. The gate lock as claimed in claim 1, in which the first or second C-shaped portions have an open end and at least one of the open ends is oriented generally inwardly.

6. The gate lock as claimed in claim 1, in which the first or second C-shaped portions have an open end and at least one of the open ends is oriented generally outwardly.

7. The gate lock as claimed in claim 1, wherein the second sleeve further comprises an adjustable stop that limits the passage of the bolt member through the second sleeve.

8. The gate lock as claimed in claim 7, in which the adjustable stop comprises a stop block secured to the second portion and a pin removably receivable into the bolt member.

9. The gate lock as claimed in claim 1, in which the bolt member comprises a channel shaped member.

10. The gate lock as claimed in claim 1, further comprising shackle protectors partially surrounding the opening in the first portion.

11. The gate lock as claimed in claim 1, in which the locking member comprises a shackle of a padlock.

12. The gate lock as claimed in claim 1, in which the locking member comprises an integrally mounted locking mechanism.

13. The gate lock as claimed in claim 1, in which the locking member comprises an integrally mounted cam lock.

14. The gate lock as claimed in claim 1, further comprising a spacer adapted to fit inside the first or second C-shaped portion, between the first or second C-shaped portion and at least one of the tubular gate members, to allow adjustment of the gate lock to accommodate different sized tubular gate members.

15. A gate lock for securing gates having tubular gate members, the gate lock comprising:

a bolt member having a fixed stop at one end thereof and an engaging member extending outwardly therefrom, the bolt member further defining a hole therethrough;

a first portion including a first mounting clevis to at least partially surround a first tubular gate member, a sleeve defining an opening to receive a lock member, and a notch, the first mounting clevis being inwardly deformable to grip the first tubular gate member;

a second portion including a second mounting clevis to at least partially surround a second tubular gate member, and a second sleeve being dimensioned to receive the bolt member therethrough but not allowing the passage of the stop therethrough, the second mounting clevis being inwardly deformable to grip the second tabular gate member; and the engaging member being positioned so that when the engaging member is engaged with the notch, the hole aligns with the opening to receive a locking member through both the hole and the opening for locking the bolt member to the first portion.

16. The gate lock as claimed in claim 15, in which the first or second mounting clevises are shaped to fit a tubular gate member having a generally circular cross section.

17. The gate lock as claimed in claim 15, in which the first or second mounting clevises are shaped to fit a tubular gate member having a generally square cross section.

18. The gate lock as claimed in claim 15, in which the first or second mounting clevises have an open end and at least one of the open ends is oriented generally inwardly.

19. The gate lock as claimed in claim 15, in which the first or second mounting clevises have an open end and at least one of the open ends is oriented generally outwardly.

20. The gate lock as claimed in claim 15, wherein the second sleeve further comprises an adjustable stop that limits the passage of the bolt member through the second sleeve.

21. The gate lock as claimed in claim 20, in which the adjustable stop comprises a stop block, secured to the second portion and a pin removably receivable into the bolt member.

22. The gate lock as claimed in claim 15, in which the bolt member comprises a channel shaped member.

23. The gate lock as claimed in claim 15, further comprising shackle protectors partially surrounding the opening in the first portion.

24. The gate lock as claimed in claim 15, in which the locking member comprises a shackle of a padlock.

25. The gate lock as claimed in claim 15, in which the locking member comprises an integrally mounted locking mechanism.

26. The gate lock as claimed in claim 15, in which the locking member comprises an integrally mounted cam lock.

27. The gate lock as claimed in claim 15, further comprising a spacer adapted to fit inside the first or second mounting devises, between the first or second mounting clevises and at least one of the tubular gate members, to allow adjustment of the gate lock to accommodate different sized tubular gate members.

28. A method of securing a gate, the gate comprising tubular gate members, the method comprising the steps of:

placing a first gate lock portion, including a first C-shaped portion, so that the first C-shaped portion at least partially surrounds a first tubular gate member, the first gate lock portion further comprising a first sleeve defining an opening to receive a lock member, and a notch;

placing a second gate lock portion, including a second C-shaped portion, so that the second C-shaped portion at least partially surrounds a second tubular gate member and is proximate the first gate lock portion, the second gate lock portion further comprising a second sleeve being dimensioned to receive a bolt member therethrough, the bolt member having a fixed stop at one end thereof and an engaging member extending outwardly therefrom, the bolt member further defining a hole therethrough, the second sleeve being sized to not allow the passage of the stop therethrough;

sliding the bolt member within the second sleeve until it is positioned so that the engaging member is engaged with the notch and so that the hole aligns with the opening; and inserting a locking member through both the hole and the opening for locking the bolt member to the first portion to secure the gate in a closed position.

29. The method as claimed in claim 28, further comprising the step of inserting a pin into an opening in the bolt member such that the pin interferes with a stop block on the second gate lock portion to limit the motion of the bolt member through the second gate lock portion.

30. The method as claimed in claim 28, further comprising the step of placing mounting clevises at least partially surrounding at least one tubular gate member and deforming the mounting clevises inwardly to grip the at least one tubular gate member.

31. A gate lock for securing gates having tubular gate members, the gate lock comprising:

a first gate lock portion, including first means for at least partially surrounding a first tubular gate member, the first gate lock portion further comprising a first means for receiving a means for bolting, the first means for receiving having a notch and defining an opening to receive a lock member;

a second gate lock portion, including second means for at least partially surrounding a second tubular gate member, the second gate lock portion further comprising a second means for receiving the means for bolting, the second means for receiving being dimensioned to receive the means for bolting therethrough, the means for bolting having a fixed stop at one end thereof and an engaging member extending outwardly therefrom, the means for bolting further defining a hole therethrough, the second means for receiving being sized to not allow the passage of the stop therethrough; and means for locking dimensioned to pass through both the hole and the opening for locking the means for bolting to the first portion to secure the gate in a closed position.

32. The gate lock as claimed in claim 31, further comprising means for deformably gripping at least one of the tubular gate members.

33. The gate lock as claimed in claim 31, wherein the second gate lock portion further comprises means for adjustably stopping the advancement of the means for bolting through the second gate lock portion.

34. A gate lock for securing gates, the gate lock comprising:

a bolt member having a fixed stop at one end thereof an engaging member extending outwardly therefrom, the bolt member further defining a hole therethrough;

a first portion including a first sleeve defining an opening to receive a lock member, and a notch;

a second portion positionable proximate the first portion, the second portion including a second sleeve being dimensioned to receive the bolt member therethrough but not allowing the passage of the stop therethrough; and the engaging member being positioned so that when the engaging member is engaged with the notch, the hole aligns with the opening to receive a locking member through both the hole and the opening for locking the bolt member to the first portion and the second portion further comprising a second C-shaped portion to at least partially surround a second tubular gate member.

35. The gate lock as claimed in claim 34, the first portion further comprising a first C-shaped portion to at least partially surround a first tubular gate member, and the second portion further comprising a second C-shaped portion to at least partially surround a second tubular gate member.

36. The gate lock as claimed in claim 35, wherein at least one of the first or second C-shaped portions further comprises a mounting clevis having ears that are inwardly deformable around at least one of the first or second tubular gate members.

37. The gate lock as claimed in claim 35, in which the first or second C-shaped portions are shaped to fit a tubular gate member having a generally circular cross section.

38. The gate lock as claimed in claim 35, in which the first or second C-shaped portions are shaped to fit a tubular gate member having a generally square cross section.

39. The gate lock as claimed in claim 35, in which the first or second C-shaped portions have a generally inwardly oriented open end.

40. The gate lock as claimed in claim 35, in which the first or second C-shaped portions have a generally inwardly oriented open end.

41. The gate lock as claimed in claim 34, further comprising an adjustable stop that limits the passage of the bolt member through the second sleeve.

42. The gate lock as claimed in claim 34, in which the adjustable stop comprises a stop block secured to the second portion and a pin removably receivable into the bolt member.

43. The gate lock as claimed in claim 34, in which the bolt member comprises a channel shaped member.

44. The gate lock as claimed in claim 34, further comprising shackle protectors partially surrounding the opening in the first portion.

45. The gate lock as claimed in claim 34, in which the locking member comprises a shackle of a padlock.

46. The gate lock as claimed in claim 34, in which the locking member comprises an integrated locking mechanism.

47. The gate lock as claimed in claim 34, the first portion further comprising a first plate for mounting to a generally flat gate member portion.

48. The gate lock as claimed in claim 34, the second portion further comprising a second plate for mounting to a generally flat gate member portion.

* * * * *